US011292120B2

(12) United States Patent
Reynolds

(10) Patent No.: US 11,292,120 B2
(45) **Date of Patent: *Apr. 5, 2022**

(54) WORK BENCH

(71) Applicant: Greg Reynolds, Mount Pleasant, SC (US)

(72) Inventor: Greg Reynolds, Mount Pleasant, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/234,129

(22) Filed: Apr. 19, 2021

(65) Prior Publication Data

US 2021/0237254 A1 Aug. 5, 2021

Related U.S. Application Data

(63) Continuation-in-part of application No. 15/975,803, filed on May 10, 2018, now Pat. No. 11,000,943.

(51) Int. Cl.

| | |
|---|---|
| ***B25H 1/04*** | (2006.01) |
| ***B25H 1/16*** | (2006.01) |
| ***B25H 1/08*** | (2006.01) |
| ***A47B 5/06*** | (2006.01) |

(52) U.S. Cl.

CPC ..... *B25H 1/04* (2013.01); *A47B 5/06* (2013.01); *B25H 1/08* (2013.01); *B25H 1/16* (2013.01)

(58) Field of Classification Search

CPC .... B25H 1/04; B25H 1/08; B25H 1/16; A47B 5/06

USPC ..... 211/187, 193

See application file for complete search history.

(56) References Cited

U.S. PATENT DOCUMENTS

| | | | | |
|---|---|---|---|---|
| 1,337,886 | A | 4/1920 | DeBakey | |
| 1,727,032 | A | 9/1929 | Guignon, Jr. | |
| 3,990,582 | A * | 11/1976 | Schindel | A47F 5/0068 211/105.1 |
| 4,018,340 | A | 4/1977 | Gold | |
| 4,819,900 | A * | 4/1989 | Funk | A47B 57/44 108/108 |
| 5,381,738 | A | 1/1995 | Meyer | |
| 5,775,655 | A * | 7/1998 | Schmeets | A47B 5/00 108/115 |
| 5,820,004 | A | 10/1998 | Lane | |
| 6,029,833 | A | 2/2000 | Yeh | |
| 6,039,416 | A * | 3/2000 | Lambert | A47B 5/06 108/48 |
| 6,240,856 | B1 | 6/2001 | Paskey et al. | |

(Continued)

FOREIGN PATENT DOCUMENTS

FR 429931 5/1911

*Primary Examiner* — Daniel J Rohrhoff

(74) *Attorney, Agent, or Firm* — Ernest B. Lipscomb, III; Hellman & Yates, PA

(57) ABSTRACT

A work bench which is easily disassembled for storage or moving to a new location and may be attached to a support surface such as the side of a cargo trailer, van or a wall. The work bench includes a pair of work bench frames is connected to a support surface by a pair of mounting standards spaced apart from one another and mounted to the support surface. The pair of work bench frames each comprise a work bench support flange, at least one cross-member hanger along with at least one crossmember. The work bench frames are the supports for a work bench work surface. There is also provided a bench support extension connected to the work bench used as a support for material larger than the work surface.

7 Claims, 6 Drawing Sheets

(56) References Cited

U.S. PATENT DOCUMENTS

| | | | | |
|---|---|---|---|---|
| 6,347,592 | B1 | 2/2002 | Gessert | |
| 6,824,183 | B1 | 11/2004 | Hodge | |
| 7,152,261 | B2 | 12/2006 | Jackson | |
| 7,481,254 | B2 | 1/2009 | Welsh et al. | |
| 7,523,903 | B1 * | 4/2009 | Rindoks | A47B 96/028 211/187 |
| 7,604,027 | B2 | 10/2009 | Thatcher | |
| 9,102,286 | B1 | 8/2015 | Deming et al. | |
| 9,216,507 | B2 * | 12/2015 | Kirchgessner | B25H 1/02 |
| 2007/0029011 | A1 | 2/2007 | Thatcher | |
| 2007/0241072 | A1 * | 10/2007 | Bryant | A47B 96/061 211/90.02 |
| 2009/0127413 | A1 | 5/2009 | Herron, III et al. | |
| 2013/0000525 | A1 * | 1/2013 | Hall | A47B 5/06 108/36 |
| 2014/0027603 | A1 * | 1/2014 | McCoy | H02G 3/30 248/562 |
| 2015/0027972 | A1 | 1/2015 | Andersson et al. | |
| 2018/0132611 | A1 * | 5/2018 | Lu | A47B 57/42 |
| 2019/0344424 | A1 | 11/2019 | Reynolds | |
| 2020/0164781 | A1 | 5/2020 | Pascarella | |
| 2020/0288866 | A1 * | 9/2020 | Richard | A47B 96/06 |

* cited by examiner

WORK BENCH

CROSS-REFERENCE TO RELATED APPLICATIONS

The contents of U.S. patent application Ser. No. 15/975,803 filed May 10, 2018, on which the present continuation-in-part application is based, and benefit claimed under 35 U.S.C. § 119(e), is incorporated by reference

BACKGROUND OF THE INVENTION

1. Field of the Invention

The present invention relates to work benches. More specifically, this invention relates to a modular work bench that may be modified to be used in a variety of ways, such as attached to a support surface, such as a wall or the side of a cargo trailer, van, truck, freestanding or attached to the tailgate of a vehicle and easily disassembled for storage and transportation.

2. Description of Related Art

Broadly speaking, a workbench is essentially a table that is sufficiently strong to support a workpiece or device for a user to work on. Historically work benches have been designed for specific uses such as for sawing or planing wood which a cabinetmaker might use. Other work benches are designed for other specific purposes which are as imaginative as any particular need. While there are a variety of work benches available most are as stationary or cumbersome as they are bulky and/or designed to be used in a single location or for a singular purpose. For example, where the workbench is a wall mounted unit the work bench may be permanent and take up a sizeable amount of space. The prior art is replete with these types of work benches. Other work benches have been designed to include folding components that allow the work bench to be stored in a relatively small space. While some of these work benches are useful for specific purposes, there remains a need for a work bench that is easily disassembled and stored in a small space and further is versatile enough to be used in different environments.

SUMMARY OF THE INVENTION

In accordance with the present invention, there is provided a work bench which is easily disassembled for storage or moving to a new location and may be adapted for use in various embodiments. The work bench of this invention may be altered to be used in several versions, i.e., a mounted version, a freestanding version, and a tailgate version. Among the preferred embodiments of this invention are the mounted versions, which include a pair of work bench support frames connected to a vertical surface or nearly vertical surface by a pair of support standards spaced apart from one another and directly mounted to the surface, such as a wall or the side of a cargo trailer, van or truck. The work bench support frames are constructed of a durable material, such as steel or plywood. In one preferred embodiment the support standards are L-shaped with holes on one side to attach to a structure and additional holes on the other side for attaching the work bench frames. The work bench support frames are attached to the wall standards through the holes in any conventional manner such as using cotterless hitch pins or bolts.

Each work bench support frame has a series of holes used to connect the support frame to a support standard. The work bench support frame may be vertically adjusted by moving the frame up or down to match reciprocal holes in the support standard. Attached to each work bench support frame is a pair of cross-member hangers. The work bench support frames are made of any suitable material such as steel or plywood. As normally used, the work bench includes two support frames that are mirror images of each other. The cross-member hangers support the crossmembers that support the planar work surface resting on the work support frames and add stability to the work bench. The crossmembers are preferably attached to the planar work surface.

A removable planar work surface is positioned atop of the work bench support frames. A pair of crossmembers, such as 2*x*4*s*, are positioned to fit into the cross-member hangers to support the planar work surface and may be attached thereto. There is also provided a vertically adjustable support leg to each work bench support frame.

It is often the case that when using a work bench the working surface is not as large as the material to be worked on creating an awkward situation where the material being worked on is unbalanced. There is provided a work bench support extension used as a support for material larger than the work surface; thus, extending the size of the workpiece that may be held on the planar work surface. The work bench support extension is connected to the work bench support. The work bench support extension has horizontal and vertical adjustment. The work bench support extension adjusts vertically using a rod and a pair of fasteners that support the workpiece support extension member.

It is therefore the general object of the present invention to provide a work bench which may be sufficiently versatile to be used in different environments.

Another object of the present invention is to provide a work bench that can handle a workpiece that is larger than the work bench surface.

Yet another object of the present invention is providing a work bench that is easy to set up and disassemble for storage in a small space.

Other objects, features and advantages of the invention will be apparent to those skilled in the art from the following detailed description of the invention taken in conjunction with the drawings.

BRIEF DESCRIPTION OF THE DRAWINGS

Having described the invention in general terms, reference will now be made to the accompanying drawings, which are not necessarily drawn to scale, and wherein.

DESCRIPTION OF THE PREFERRED EMBODIMENTS

The present inventions now will be described more fully hereinafter with reference to the accompanying drawings, in which preferred embodiments of the invention are shown. This invention may, however, be embodied in many different forms and should not be construed as limited to the embodiments set forth herein; rather these embodiments are provided so that this disclosure will be thorough and complete and will fully convey the scope of the invention to those skilled in the art. Like numbers refer to the elements throughout.

Figure 1:
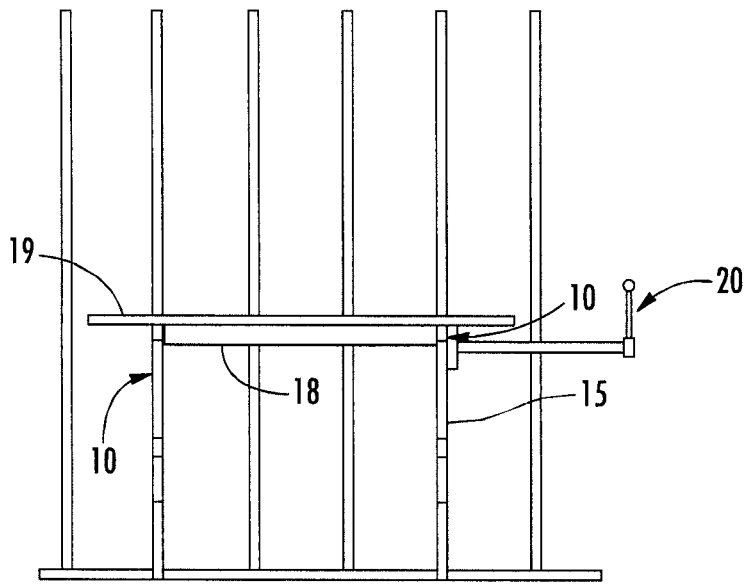
FIG. 1 is a front view of a first embodiment of the wall mounted work bench of the present invention illustrating the support frame of the work bench attached to wall studs showing the work surface on the support frame.
Figure 2:
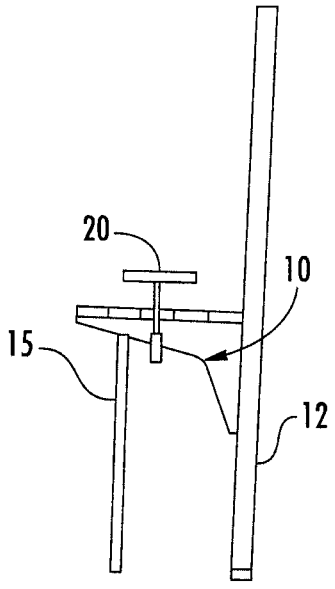
FIG. 2 is a side view of the wall mounted work bench embodiment of FIG. 1 of the present invention illustrating the frame of the work bench attached to wall studs.
Figure 3:
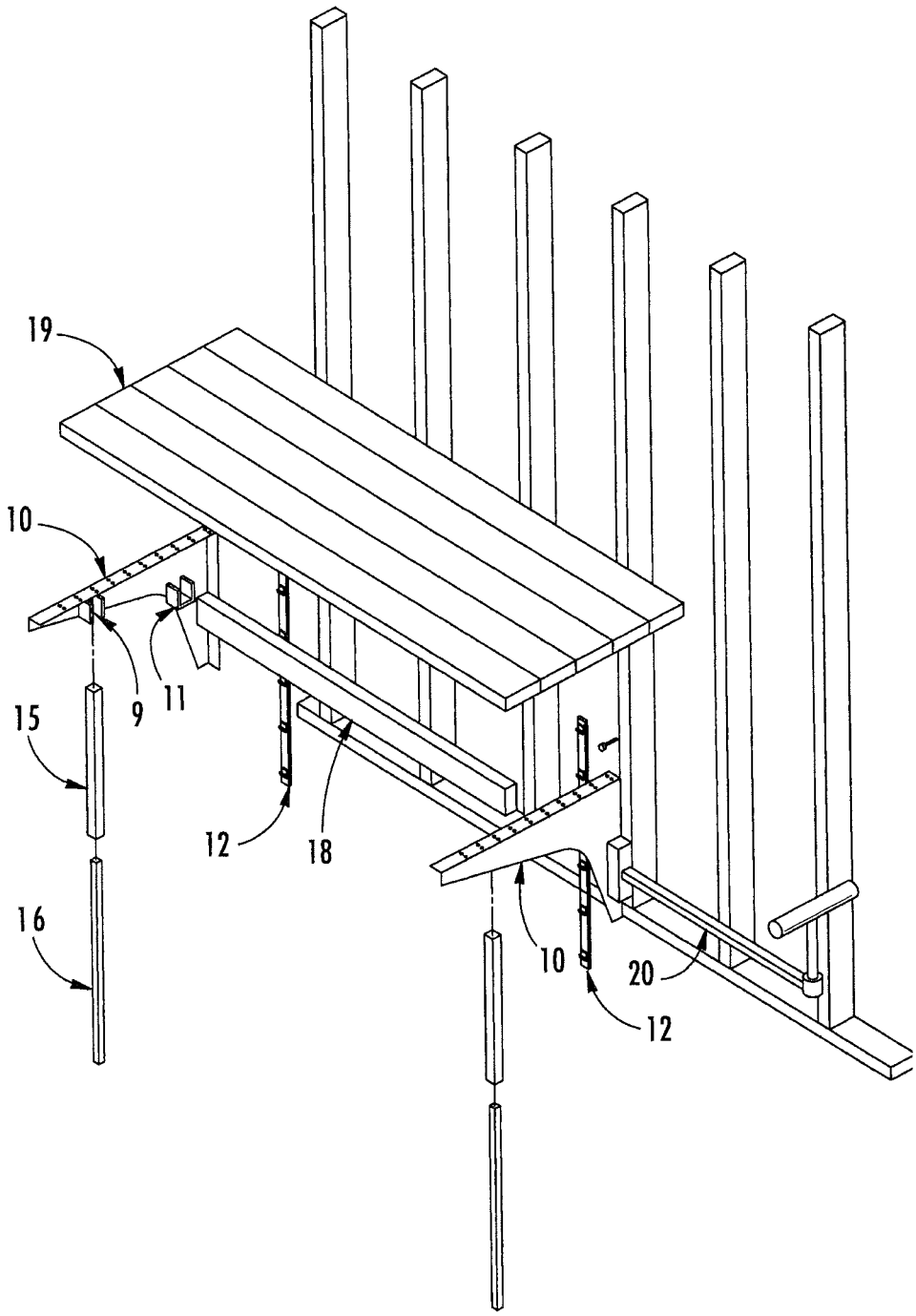
FIG. 3 is a front perspective view of the unassembled wall mounted work bench of FIG. 1.

The modular work bench of this invention is found in a variety of embodiments. One of the preferred embodiments is the wall mounted version. The work bench frames 10 of the wall mounted embodiment are shown in FIG. 1 in an assembled condition mounted to the studs of a wall. In FIG. 3 the wall mounted work bench frames 10 are shown in an unassembled condition. The work bench frames 10 are constructed of a durable material, preferably steel. To connect frame 10 to a wall, a wall mount support standard 12 is attached to a support surface, e.g., a wall, a stud or any other vertical surface strong enough to support the work bench. As shown in FIG. 2 and FIG. 3 a pair of wall mounted support standards 12 spaced apart from one another are attached directly to the wall studs but it should be understood that the support standards 12 may be attached other suitable support surface.

Figure 7:
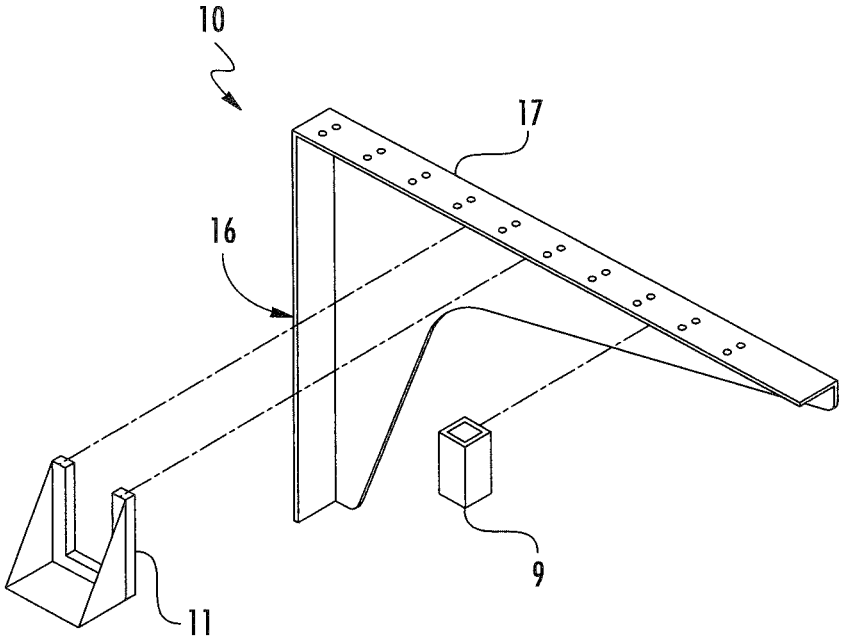
FIG. 7 is an isometric view of the work bench frame of the work bench of the present invention illustrating the embodiment of FIG. 1.
Figure 8:
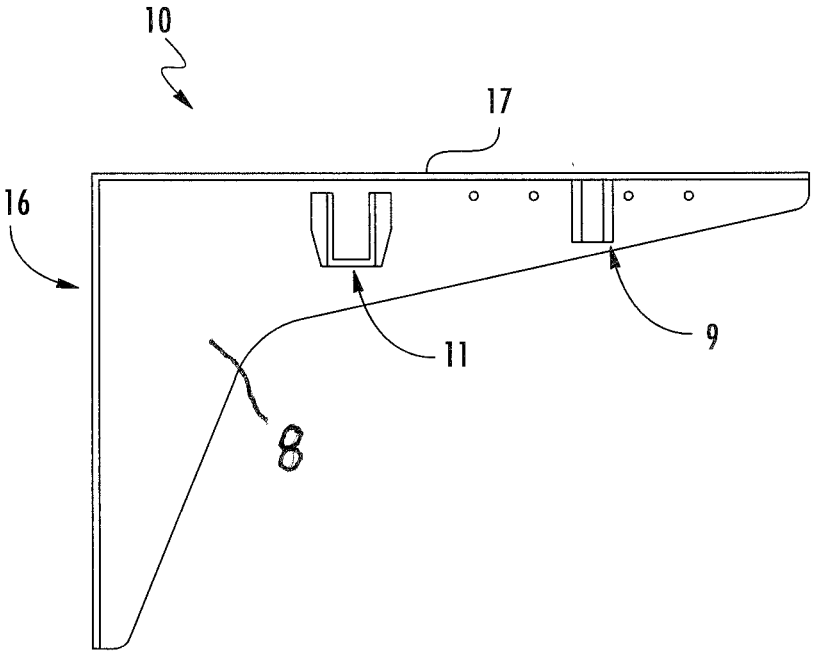
FIG. 8 is a side view of the work bench frame used to form the work bench of the embodiment of FIG. 1.

As shown in FIG. 7 and FIG. 8, the workbench frame 10 has a vertical flange 16 which is used to connect frame 10 to the wall support standard 12 through a series of slots, a tabletop support flange 17 to support a work surface. The vertical flange 16 and the tabletop support flange 17 are jointed together at one end, such as by welding and stability is added to the frame 10 by support member 8. The frame 10 also includes support leg sleeve 9 and a cross-member hanger 11. As normally used the work bench includes two frames 10. However, if desired, more than two frames may be used where stability of the work surface may be an issue. The right and left work bench frames 10 of the embodiment of FIG. 3 are interchangeable. The work bench frames 10 are the support by which the work surface 19 is attached. The work bench frames 10 connect to the wall or to the support standard 12 via slots in vertical flange 16 as shown in FIG. 7. Leg support sleeve 9 connects to support member 8 and allows for the insertion of vertical adjustable legs 15 as shown in FIG. 3. Cross-member hanger 11 as shown in FIG. 8 attaches to support member 8 and allows for connection between frames 10 using cross-member 18 as shown in FIG. 3. The work surface and frames may be easily removed from the wall mount support standards and the frames 10, placed into storage or moved to a different location.

In FIG. 7, frame 10 is shown dissembled. Top flange 17 of frame 10 has holes to allow for connection to the work surface 19 as shown in FIG. 3. Top flange 17 also contains small sharp tabs that provide grip to the work surface 19 to avoid sliding on frame 10. Vertical flange 16 contains horizontal slots to accept the clips from support standard 12 and keyhole slots for attachment to a suitable support surface. Atop of the tabletop support flange 17 is work surface 19. The entire work surface may be a single piece of material, e.g., wood, or may comprise several sections which fit together on the tabletop support flange 17.

Figure 9:
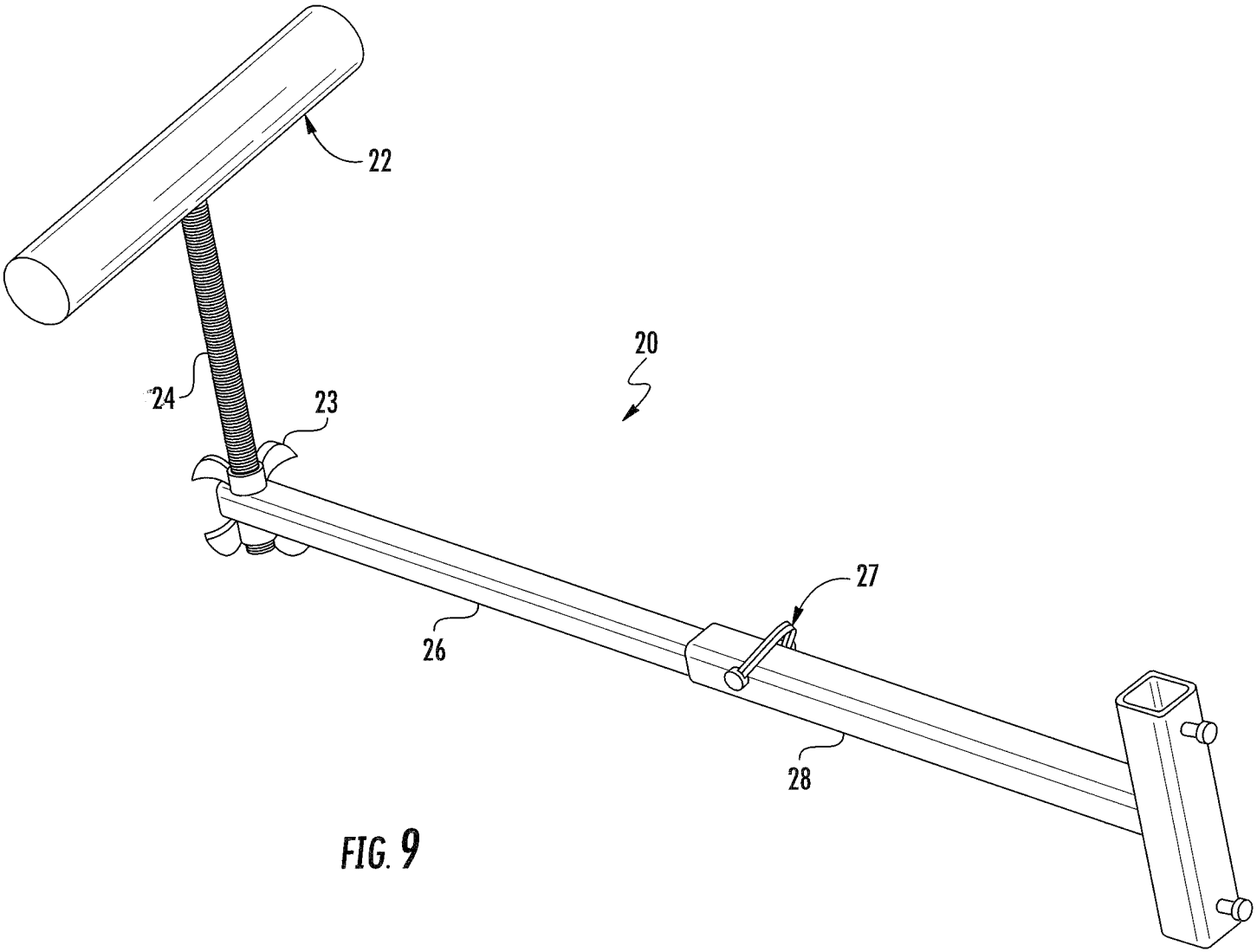
FIG. 9 is a perspective view of the assembled bench support extension used in the embodiments of the present invention.

It is often the case that when using a work bench the working surface is not as large as the material to be worked on creating an awkward situation where the material being worked on is unbalanced. Thus, as one of the objectives of this invention a bench support extension is provided, such as the one shown in FIG. 9. Bench support extension 20 is used as a support for material longer than the work surface of 19 thus imposing no limit on the size of the workpiece that may be held on the work surface. Bench support extension 20 can be connected to frame 10 via a pair of fasteners 21. The bench support extension 20 has horizontal and vertical adjustment. The bench support extension 20 adjusts horizontally via a pair of nesting tubes 26, 28 and is secured using retainer 27. The bench support extension 20 adjusts vertically using rod 24 and a pair of nuts 23 that supports workpiece support member 22. Bench support extension 20 can be used with all the alternative work bench assemblies described herein.

Figure 4:
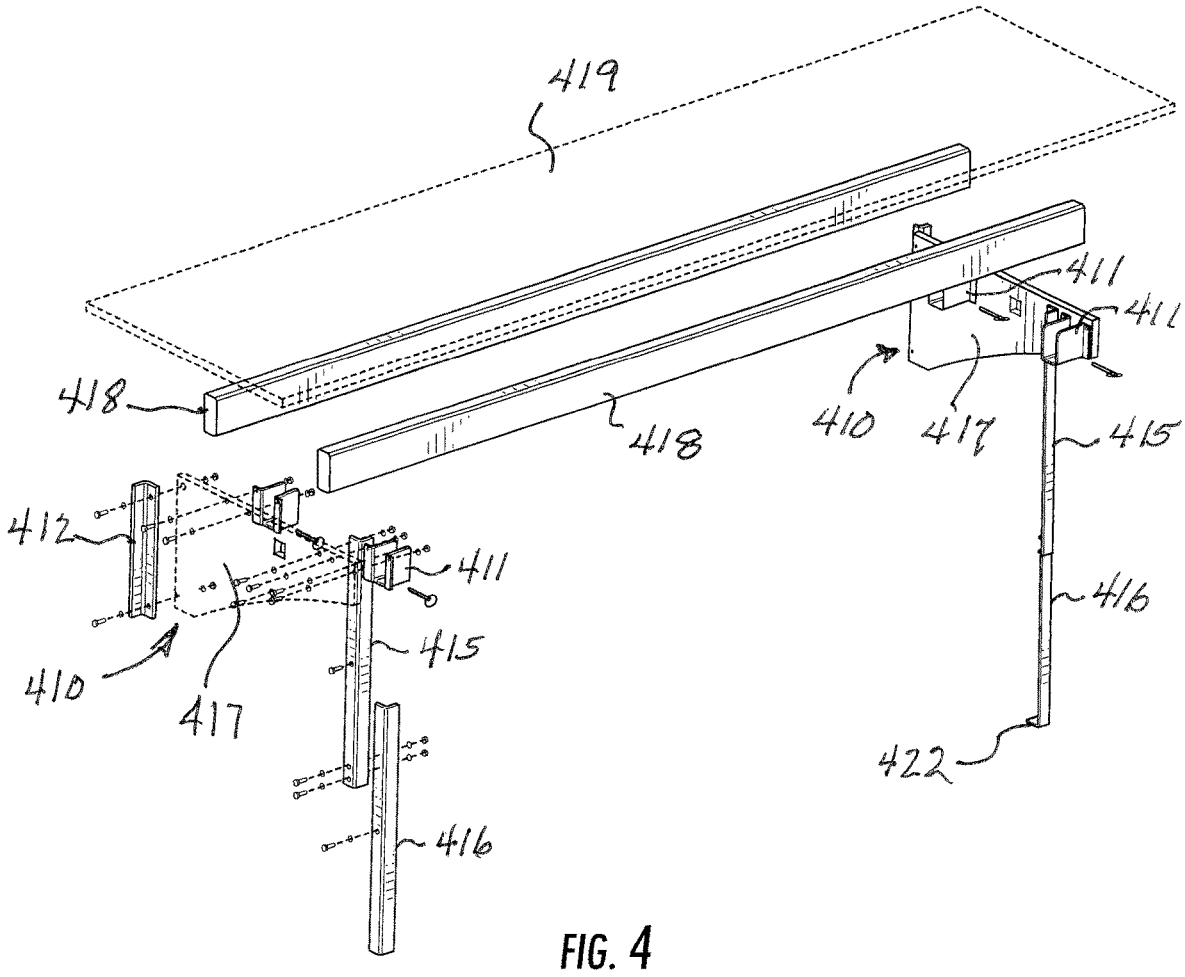
FIG. 4 is an isometric view of another embodiment of the present invention illustrating unassembled components of the work bench of the present invention.
Figure 5:
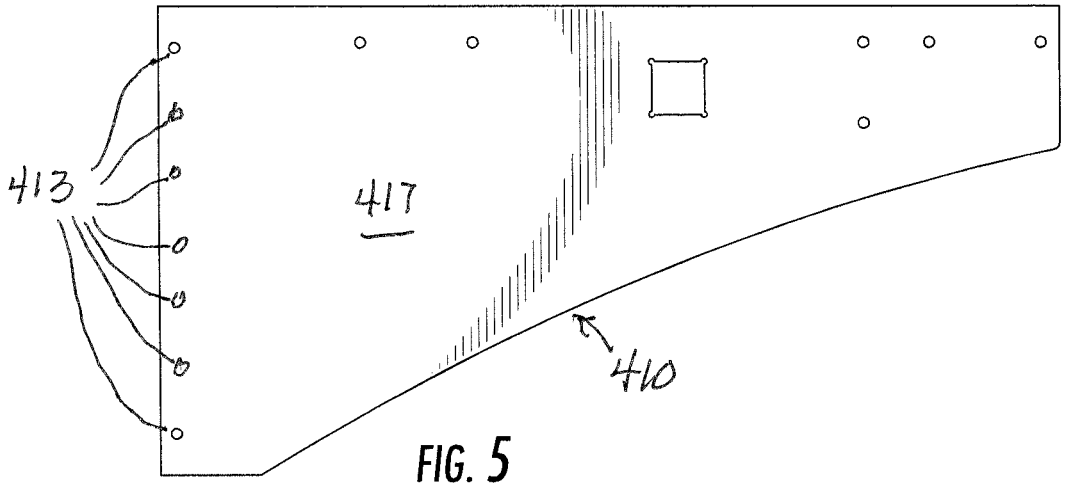
FIG. 5 is a side view of the work bench frame of the work bench of FIG. 4 of the present invention.

Another embodiment of the modular work bench of the present invention is shown in FIG. 4. In this embodiment the work bench is attached to a support surface such as a wall or the side of a cargo trailer, van or truck by a pair of spaced apart mounting support standards 412. The mounting support standards are preferably made of L-shaped angle iron and are bolted or otherwise directly attached the support surface which is typically vertical or nearly vertical. The modular work bench has a pair of a pair of work bench frames 410 which support a work surface 419. As shown in FIG. 5, the work bench frames 410 are comprised of a workbench support flange 417 made of any suitable material such as steel or plywood. The work bench work bench frames 410 include a series of holes 413 for attachment to the mounting support standards 412. Accordingly, because each work bench frame 410 is attached with fasteners the L-shaped mounting support standard 412 are vertically adjustable depending on which of the holes are used for attachment. Likewise, the L-shaped mounting support standards 412 may also have a series of holes on the side of the L-shape that is perpendicular to the support surface for the same purpose.

Figure 6:
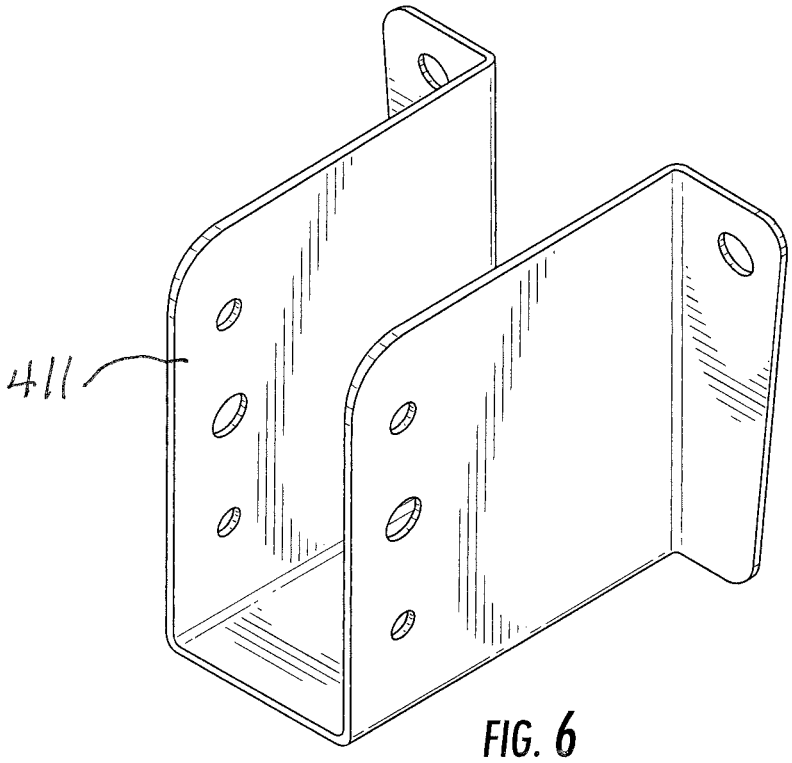
FIG. 6 is an isometric view of a cross-member hanger that is attached to the work bench frame of the embodiment of FIG. 4 of the present invention.

A pair of cross-member hangers 411, such as shown in FIG. 6, are attached to each workbench support flange 417 for supporting a crossmember 418. The work bench support flanges 417 are mirror images of each other and capable of being removably connected to the mounting support standards 412. Crossmembers 418 are sized to be held by the cross-member hangers 411 on each work bench support flange to provide additional support and stability to the work surface 419. The planer work surface 419 may simply be placed on the work bench support flanges 417 or preferable the planar work surface may be attached to the crossmembers 418.

The modular work bench may also include a pair of free-standing support legs 415/416. Upper legs 415 are attached to the work bench support flange 417 toward the outer end thereof to provide maximum support. The legs may be bolted directly to the support flange 417 or attached to the flange by leg sleeves 421. Upper legs 415 are hollow to allow for the insertion of legs 416 as shown in FIG. 4. Lower leg 416 fits into upper support leg 415 and each leg is vertically adjustable to aid in making the planer work surface level. Lower legs 416 may have a steel plate affixed to the bottom of legs 416 and have a threaded hole therein so that adjustable leveling feet 422 attached to the bottom of each leg. The feet 422 can be adjusted up or down to compensate for irregularity in the floor or ground.

The embodiment of the work bench shown in FIG. 4 may also include a bench support extension 20 mounted to one of said work bench frames 410 adapted to support material longer than work surface 419. Thus, as one of the objectives of this invention a bench support extension is provided, such as the one shown in FIG. 9. Bench support extension 20 is used as a support for material longer than the work surface 419 thus imposing no limit on the size of the workpiece that may be held on the work surface. Bench support extension 20 can be connected to frame 410 via a pair of fasteners 21. The bench support extension 20 has horizontal and vertical adjustment. The bench support extension 20 adjusts horizontally via a pair of nesting tubes 26, 28 and is secured using retainer 27. The bench support extension 20 adjusts vertically using rod 24 and a pair of nuts 23 that supports workpiece support member 22. Bench support extension 20 can be used with the alternative work bench assemblies described hereinafter. The bench support extension 20 used with the embodiment of the invention shown in FIG. 4 is the same as that for the wall mounted embodiment shown in FIG. 1.

Many modifications and other embodiments of the inventions set forth herein will come to mind to one skilled in the art to which these inventions pertain having the benefit of the teachings presented in the foregoing descriptions. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A modular workbench comprising:

a pair of spaced apart mounting support standards attached to a support surface;

a pair of work bench frames comprising; workbench support flanges, said flanges being mirror images of each other and capable of being removably connected to said mounting support standards, a pair of cross-member hangers are attached to each work bench support flange for supporting a crossmember;

a crossmember sized to be held by the cross-member hangers on each work bench support flange provides additional support and stability to a work surface; and a planar work surface removably connected to said workbench support flanges.

2. The work bench according to claim 1 wherein said planer work surface is removably connected to said crossmember.

3. The work bench according to claim 1 wherein said work bench frames are vertically adjustable.

4. The work bench according to claim 1 wherein said mounting support standards are attached to a vertical surface.

5. The work bench according to claim 1 further comprising a vertically adjustable support leg attached to each of said work bench frames.

6. The work bench according to claim 1 further comprising a bench support extension mounted to one of said work bench frames adapted to support material longer than said work surface.

7. The work bench according to claim 6 further comprising a pair of freestanding support legs attached to each of said work bench frames and having adjustable feet attached to the bottom of each leg.

* * * * *